US005941554A

United States Patent [19]

Bourdeau

[11] Patent Number: 5,941,554

[45] Date of Patent: Aug. 24, 1999

[54] SPORTS BOOT FOR SNOWBOARDING

[75] Inventor: Joel Bourdeau, Saint-Jorioz, France

[73] Assignee: Salomon S.A., Metz-Tessy, France

[21] Appl. No.: 08/869,481

[22] Filed: Jun. 5, 1997

[30] Foreign Application Priority Data

Jun. 6, 1996 [FR] France ..... 96 07261

[51] Int. Cl.[6] ..... A63C 9/00; A43B 5/04

[52] U.S. Cl. ..... 280/617; 280/14.2; 36/117.1; 36/109; 36/107

[58] Field of Search ..... 36/117.1, 115, 36/109, 107, 117.4, 118.3, 118.4, 119.1; 280/14.2, 617, 618, 629, 633

[56] References Cited

U.S. PATENT DOCUMENTS

| | | | |
|---|---|---|---|
| 3,854,743 | 12/1974 | Hansen . | |
| 4,979,760 | 12/1990 | Derrah . | |
| 5,356,170 | 10/1994 | Carpenter et al. | 280/618 |
| 5,406,721 | 4/1995 | Marcolin | 36/105 |
| 5,435,080 | 7/1995 | Meiselman | 36/117 |
| 5,505,477 | 4/1996 | Turner et al. . | |
| 5,606,808 | 3/1997 | Gilliard et al. . | |
| 5,701,689 | 12/1997 | Hansen et al. . | |
| 5,732,483 | 3/1998 | Cagliari . | |

FOREIGN PATENT DOCUMENTS

| | | |
|---|---|---|
| 646334 | 4/1995 | France . |
| 96/36407 | 11/1996 | WIPO . |

*Primary Examiner*—Ted Kavanaugh
*Attorney, Agent, or Firm*—Greenblum & Bernstein, P.L.C.

[57] ABSTRACT

A sports boot adapted to be associated to a glide board for snowboarding, via a detachable binding device that includes a rear support spoiler that is relatively rigid. The boot includes an external sole overhung with a shell base that extends towards the lower part of the user's leg via a relatively flexible upper that is capable of cooperating with the rear support spoiler which is relatively rigid, and affixed to the board, during a rear edge setting, wherein the upper includes an arrangement for distributing the pressure exerted on the lower part of the user's leg when the upper takes support on the spoiler, such arrangement including a relatively rigid plate attached to a more flexible rear zone of upper and insulated from all the rigid parts of the boot in order to maintain the flexibility of the upper.

16 Claims, 1 Drawing Sheet

SPORTS BOOT FOR SNOWBOARDING

BACKGROUND OF THE INVENTION

1. Field of the Invention

The present invention is related to a sports boot that is adapted to be associated with a glide board for snowboarding, the boot including an upper that is affixed to sole adapted to cooperate with the board.

2. Description of Background Information

Several types of boots exist for practicing the above-mentioned sport. Rigid boots are known to be attached to the board via a system of rear and front stirrups, and whose latching control is located on one of the stirrups and is activated either manually or automatically.

Flexible boots are also know, that are inserted into a shell affixed to the board, the shell including a certain number of straps adapted to affix the boot to the shell.

The main disadvantage of rigid boots lies in the fact that they do not allow for a certain slack or flexibility required for snowboarding. In addition, comfort becomes an arbitrary factor, due to their design and the rigid materials used. Also, the "walk" function is not efficient, whereas it is a function that is particularly necessary and useful for a snowboarder. In the second case, although flexible boots are extremely comfortable while walking, the complementary arrangement of flexible boots with rigid shells is unsatisfactory due to the cumbersome volume of the shells on the board, and also a certain amount of discomfort that is directly linked to the bad retention of the foot and the presence of localized contact between the flexible upper and the rigid parts of the shell.

One solution set fourth in U.S. Pat. No. 5,356,170 aims to find a compromise that enables the use of a flexible boot with a less cumbersome shell that is attached to the board.

More specifically the proposed device provides a relatively rigid rear support spoiler at the rear of the binding device of the boot, the spoiler being affixed to the board via fastening means, thus enabling the user to take support on it during a rear edge setting.

This provides definite advantages in the practice of this sport, but some disadvantages have become apparent over time.

Indeed, the difficulty lies in the fact of finding the correct compromise in the radius of curvature in a horizontal sectional plane of the rear support spoiler. As a matter of fact, if this radius is too encompassing with respect to the upper of the boot, then the spoiler can no longer provide adequate lateral flexibility slack in some snowboarding positions.

If, on the contrary, the corresponding section of the spoiler in question is given a relatively flat shape so as to avoid this disadvantage, then in this case the flexible upper of the boot that takes support against this flat surface will exert very substantial pressure on a small contact surface that corresponds overall to a generatrix of the upper of the boot with a much smaller radius, leading to substantial pressure on the lower portion of the leg, and will become synonymous with discomfort and pain.

It can also be thought that boots, such as cross-country ski boots with journaled rigid collars, could overcome the disadvantages cited hereinabove by eliminating the above cited rear support spoiler. In fact, such would not be the case at all, because regardless of whether such boots are associated or not to a rigid rear spoiler, the fact remains that the stiffness of the collars of such boots too greatly limits the lateral flexibility that is required for snowboarding. In addition, these boots are a lot less adapted for walking due to the presence of the collar that stiffens the upper of boot.

It was not possible to find a compromise solution in order to resolve the problems that have been cited hereinabove.

SUMMARY OF THE INVENTION

The present invention achieves a solution by proposing a sports boot that is adapted to be associated with a glide board for snowboarding, via a binding device that includes a relatively stiff rear spoiler, the boot including a relatively flexible upper capable of cooperating with the rear support spoiler, wherein the upper includes an arrangement for distributing the pressure exerted on the lower portion of the leg of the user when the upper takes support on the spoiler, such arrangement being constituted by a relatively rigid plate, attached to a more flexible rear zone of the upper, and insulated from all the rigid parts of the boot, so as to retain the flexibility of the upper.

It is well understood that with such a boot, in which the upper has been left with the maximum of flexible zones, the boot retains the freedom to move in all directions, thus enabling complete lateral flexibility while practicing snowboarding, and complete flexibility while walking.

However, all these advantages do not preclude the use of the pressure distribution plate, since the concentration of this pressure at the rear of the boot generally causes pain and discomfort in the calf region of the user.

The present invention is also related to the characteristics that will become apparent from the description that follows, and which should be considered singly or in all their possible technical combinations.

BRIEF DESCRIPTION OF THE DRAWINGS

This description, provided as a non-limiting example, will enable a better understanding of how the invention can be obtained, with reference to the annexed drawings wherein.

DETAILED DESCRIPTION OF THE PREFERRED EMBODIMENTS

Figure 1:
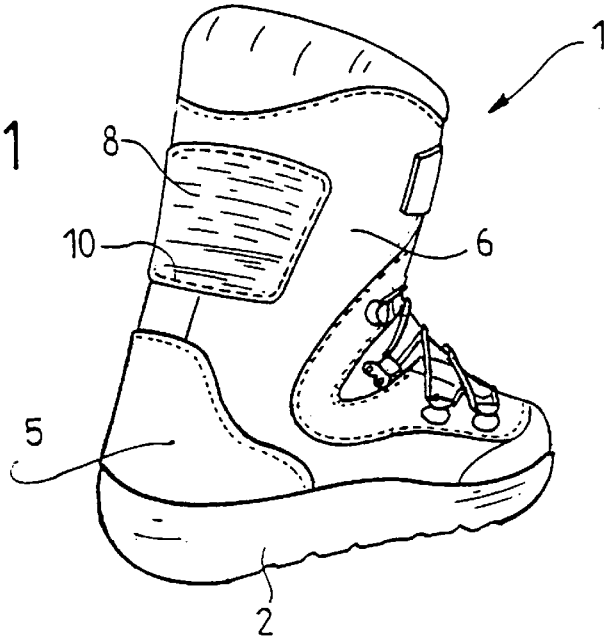
FIG. 1 is a rear perspective view of a boot according to the invention.

The boot 1 represented in the drawings is constituted of an external sole 2 adapted to be affixed on a glide board 3 by means of a binding device constituted of a rigid, intermediate cradle located between the sole 2 of the boot 1 and the board 3.

The external sole 2 of boot 1 is overhung with a rear heel stiffener 5 that can be rigid or semi-rigid, extending towards the bottom part of the leg of a user via an upper 6 that is relatively flexible, and capable of cooperating with a rear support spoiler 7 that is relatively rigid, and affixed to the board 3 by means of a binding device 4 forming a cradle. The role of the stiffener 5, which is known, is essentially that of a wear and tear resistance element. It can be made of leather, rubber or plastic.

Figure 2:
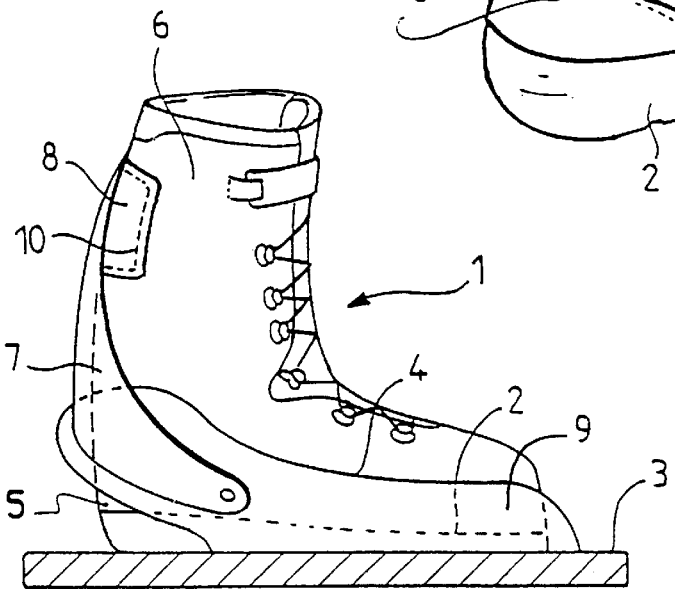
FIG. 2 is a view of the boot of FIG. 1, the boot being mounted on a glide board by means of a removable binding that includes a rear support spoiler.
Figure 3:
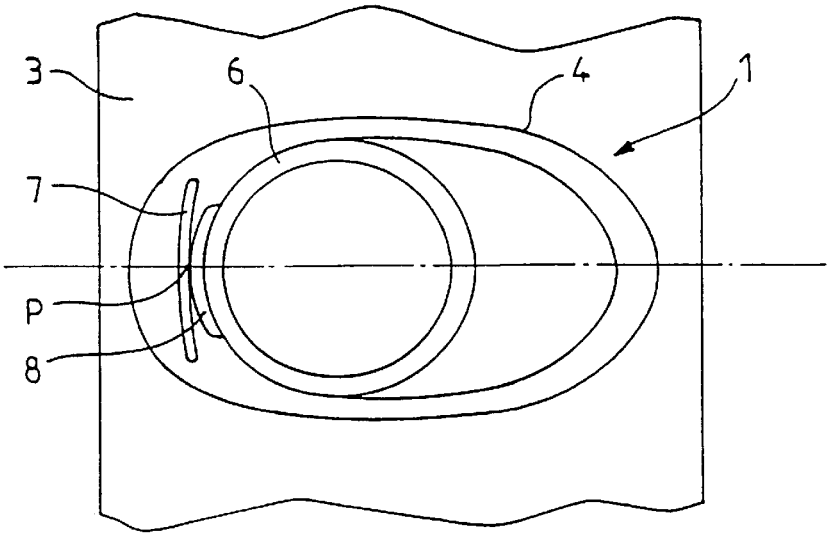
FIG. 3 is a top view of the boot shown in FIG. 2.

The binding device 4 associated to the rear support spoiler 7 is of the type described in U.S. Pat. No. 5,356,170, and consequently, will be described only summarily here. The binding device includes a base having a pair of laterally spaced side walls 9 between which the boot 1 is positioned. The rear support spoiler 7 is connected to the rear portion of each of the sidewalls, as shown in FIG. 2. The shape of the support spoiler 7, in a horizontal sectional plane, is slightly contoured, without being too encompassing in order to allow free lateral bending for the boot.

According to the invention, upper 6 includes an arrangement to distribute the pressure exerted on the lower part of the leg of the user when the upper 6 takes rear support on spoiler 7.

This arrangement is constituted of a relatively rigid plate 8 that is attached to a flexible rear zone of upper 6.

The rigid distribution plate 8 is isolated from all other rigid parts of the boot, as for example, the stiffener 5.

This is essential for the invention in order to retain the flexibility of the upper, which can thus exercise its freedom to move in a all directions, and especially in lateral flexibility.

As has already been mentioned, the boot will also retain all its flexibility characteristics that are necessary for easy and comfortable walking.

When the flexible upper 6 takes support on the rear spoiler 7 at a point P, which symbolizes a vertical contact generatrix, during a rear edge setting for example, this pressure, instead of being transmitted along the generatrix, is in fact distributed along the distribution plate 8.

It should also be noted that plate 8 is shaped in such a way that it more or less espouses the shape of the calf, and this leads to substantial pressure distribution and improvement in comfort. As shown in the figures, the pressure distribution plate 8 is forwardly concave.

As a general rule, the more encompassing the shape of the plate with respect to the shape of the calf, the greater the pressure that is capable of being borne by the user.

Consequently, the distribution plate 8 will be more contoured, i.e., it will have a greater curvature, than the rear support spoiler in a horizontal sectional plane.

According to another characteristic of the invention, the distribution plate 8 will be located in a relatively central zone of the rear portion of upper 6.

Also, according to another characteristic of the invention, the rigid plate 8 extends along a surface so as to enable adequate distribution of pressure, while simultaneously retaining enough of a flexible surface for upper 6 so that such upper can retain a maximum relative flexibility.

According to the embodiment represented in the drawings, the pressure distribution plate 8 is fixedly attached on upper 6.

Specifically the pressure distribution plate 8 is sewn on upper 6 by a stitching 10.

The distribution plate 8 can be attached via an adhesive on upper 6 rather than being sewn.

The invention also envisions the attachment of the pressure distribution plate 8 on upper 6 in a removable manner.

In this case, the pressure distribution plate 8 is attached to upper 6 via clipping means (not represented) that are arranged in a complementary manner, on the one hand on the inner surface of the plate 8, and on the other hand, on the rear outer surface of upper 6.

Similarily, regarding the principle of a detachable distribution plate 8, such plate can be attached into a corresponding pocket (not represented) obtained on the rear outer surface of upper 6.

The distribution plate 8 can be made of plastic materials that have a low friction coefficient so as to limit the friction between the boot and the rear support spoiler 7 and so as to decrease the wear and tear of this area of the boot, and in particular, of that part of the upper that is in contact with plate 8.

Although the invention has been described with reference to particular means, materials, and embodiments, it is to be understood that the invention is not limited to the particulars expressly disclosed, but the invention extends to all equivalents within the scope of the claims that follow.

The instant application is based upon the French Priority Patent Application No. 96 07261, filed on Jun. 6, 1996, the disclosure of which is hereby expressly incorporated by reference thereto, and the priority of which is hereby claimed under 35 U.S.C. §119.

What is claimed is:

1. An assembly of a sports boot adapted to be associated to a glide board for snowboarding, and a binding device for securing the sports on the glide board, the assembly comprising:

a binding device including a base, the base comprising a pair of laterally spaced side walls, and a relatively rigid rear support spoiler connected to a rear portion of the base; and a sports boot having a relatively flexible upper capable of cooperating with the rear support spoiler, wherein the upper comprises an arrangement that distributes the pressure exerted on the lower part of the leg of the user when the upper takes support on the spoiler, such arrangement comprising a relatively rigid pressure distribution plate attached in a more flexible rear zone of the upper and isolated from all rigid parts of the boot, so as to retain the flexibility of the upper, the relatively rigid pressure distribution plate having a forwardly facing concave curvature, the curvature being greater than a curvature of the rear support spoiler in a horizontal sectional plane.

2. An assembly according to claim 1, wherein the pressure distribution plate is located in a relatively central zone of the rear portion of the upper of the boot.

3. An assembly according to claim 2, wherein the pressure distribution plate is fixedly attached to the upper of the boot.

4. An assembly according to claim 2, wherein the pressure distribution plate is attached to the upper in a detachable manner.

5. An assembly according to claim 2, wherein the rigid plate extends along a surface to allow adequate pressure distribution, while simultaneously retaining adequate surface flexibility for the upper of the boot so that the upper retains maximum relative flexibility.

6. An assembly according to claim 1, wherein the rigid plate extends along a surface to allow adequate pressure distribution, while simultaneously retaining adequate surface flexibility for the upper of the boot so that the upper retains maximum relative flexibility.

7. An assembly according to claim 6, wherein the pressure distribution plate is fixedly attached to the upper of the boot.

8. An assembly according to claim 6, wherein the pressure distribution plate is attached to the upper of the boot in a detachable manner.

9. An assembly according to claim 1, wherein the pressure distribution plate is fixedly attached to the upper of the boot.

10. An assembly according to claim 9, wherein the pressure distribution plate is sewn onto the upper of the boot.

11. An assembly according to claim 9, wherein the pressure distribution plate is attached to the upper of the boot by adhesive.

12. An assembly according to claim 1, wherein the pressure distribution plate is attached to the upper of the boot in a detachable manner.

13. An assembly according to claim 12, wherein the pressure distribution plate is attached to the upper of the boot with a clipping means arranged in a complementary manner on an inner surface of the plate and on an outer surface of the upper.

14. An assembly according to claim 12, wherein a rear outer surface of the upper of the boot includes a pocket and the pressure distribution plate is attached to the upper of the boot by being positioned in the pocket.

15. An assembly according to claim 1, wherein the rear support spoiler is connected to a rear portion of the side walls of the base.

16. An assembly according to claim 1, wherein the flexible upper of the boot includes lateral portions that are made of flexible material to confer a lateral flexibility during use of the boot.

* * * * *